United States Patent [19]

Nishiguchi et al.

[11] Patent Number: 5,035,087

[45] Date of Patent: Jul. 30, 1991

[54] SURFACE GRINDING MACHINE

[75] Inventors: Masanori Nishiguchi; Takeshi Sekiguchi; Ikkei Miyoshi, all of Kanagawa; Kiyoshi Nishio, Osaka, all of Japan

[73] Assignees: Sumitomo Electric Industries, Ltd., Osaka; Asahi Diamond Industrial Co. Ltd., Tokyo; Nissei Industry Corporation, Toyonaka, all of Japan

[21] Appl. No.: 129,487

[22] Filed: Dec. 7, 1987

[30] Foreign Application Priority Data

Dec. 8, 1986 [JP] Japan ..... 61-291901
Dec. 10, 1986 [JP] Japan ..... 61-294351

[51] Int. Cl.[5] ..... B24B 7/22

[52] U.S. Cl. ..... 51/131.1; 51/165.77; 51/131.3; 51/165.8

[58] Field of Search ..... 51/131.3, 131.1, 129, 51/165.77, 283 R, 165.8, 298, 307

[56] References Cited

U.S. PATENT DOCUMENTS

| | | | |
|---|---|---|---|
| 3,698,138 | 10/1972 | Wada et al. | 51/165.8 |
| 3,939,610 | 2/1976 | Suzuki et al. | 51/165.77 |
| 4,239,503 | 12/1980 | Harris et al. | 51/295 |
| 4,478,009 | 10/1984 | Rukavina et al. | 51/165.8 |
| 4,561,863 | 12/1985 | Hashimoto | 51/295 |
| 4,575,384 | 3/1986 | Licht et al. | 51/298 |

FOREIGN PATENT DOCUMENTS

| | | | |
|---|---|---|---|
| 0962751 | 2/1975 | Canada | 51/165.77 |
| 0180175 | 5/1986 | European Pat. Off. . | |
| 2708812 | 9/1977 | Fed. Rep. of Germany . | |
| 57-132970 | 8/1982 | Japan . | |
| 61-95866 | 5/1986 | Japan . | |
| 0164773 | 7/1986 | Japan | 51/131.1 |
| 2050009 | 12/1980 | United Kingdom | 51/165.77 |

OTHER PUBLICATIONS

Manufacturing Engineering, Sep. 1977, pp. 38–45; C. Wick, "Automatic Adaptative Control of Machine Tools," p. 41.

Patent Abstracts of Japan, vol. I), No. 273 (M-518) (2329); and Japan A-61-95866 (Nisshin Kogyo) 14-0-5-1986 (Cat. D.A.).

*Primary Examiner*—Robert A. Rose

*Attorney, Agent, or Firm*—Cushman, Darby & Cushman

[57] ABSTRACT

A surface grinding machine comprises a wheel head vertically movably supported; a cup-shaped diamond wheel supported by a rotatable wheel shaft at one end of the wheel head and having an abrasive grain layer of Young's modulus $(10-15)\times 10^4$ kgf/cm$^2$ at the lower end of the wheel; a wheel shaft driving motor for rotating the cup-shaped diamond wheel supported by the wheel head; a servomotor for vertically moving the wheel head; a suitable number of chuck tables for fixing the surface of a III-V group compound semiconductor wafer on which elements have been fabricated; an index table for rotatably supporting the chuck tables; a chuck table driving motor for turning the chuck tables; a main shaft motor current analysis circuit for detecting the current value of the wheel shaft driving motor; a main shaft rotation number analysis circuit for detecting the number of rotations of the wheel shaft driving motor, and a feed speed control circuit for controlling the serevomotor in such a manner as to decrease the feed speed when the grinding resistance is greater than a predetermined resistance value, and increase the feed speed when the grinding resistance is smaller than the predetermined resistance value.

1 Claim, 4 Drawing Sheets

SURFACE GRINDING MACHINE

BACKGROUND OF THE INVENTION

The present invention relates to a surface grinding machine for grinding the back surface of a wafer of a single crystal III–V group compound semiconductor on which elements have been fabricated.

The III–V group compound semiconductors include GaAs, InSb, InP, GaP, GaSb, etc. These compound semiconductors have a common disadvantage in that they are soft and fragile compared with silicon.

A single crystal of a compound semiconductor is prepared by the Liquid Encapsulated Czochralski (LEC) or Horizontal Bridgman (HB) method. The single crystal compound semiconductor is ground into a columnar shape with the orientation flat (OF) or IF.

The columnar single crystal ingot is cut into thin discs (or square plates) called an as-cut-wafer.

In order to make the thickness even, the as-cut-wafers are subjected to both or one side lapping, and both sides or one side of each is subjected to mirror polishing. In the meantime, the wafer is subjected to etching several times to remove the layer changed in property by working, and often subjected to beveling to round the peripheral edge. The product thus obtained is called a mirror wafer.

The present invention is not concerned with grinding in the process of making the mirror wafer from the as-cut-wafer.

Various of elements are fabricated on the mirror wafer by repeating wafer processes. The elements may be light emitting elements, integrated circuits of high-speed logic elements, light receiving elements, or elements for detecting infrared rays etc. Depending on the intended purpose, varieties of wafer processes such as epitaxial growth, ion implantation, etching, vapor deposition, or insulating film formation, are used.

The present invention is intended for a wafer on which elements have been fabricated.

The wafer with elements is roughly 620 μm ~ 700 μm thick for a 3 inch diameter since the thickness of the mirror wafer is just about that size. When elements are fabricated, the thickness of a layer slightly changes because of epitaxial growth or the like by several μm to the utmost so that the thickness of the wafer almost equals to that of the mirror wafer.

The wafer is a little thick since the mechanical strength is required when elements are fabricated. If the wafer is thinner than the above value, the handling of the wafer is difficult.

In case that a semiconductor element is fabricated, the wafer is only used as a substrate and its surface of only several μm thick is necessary for the fabrication. The other part of the wafer is required to simply impart it mechanical strength.

Moreover, these elements generate heat when they are actually operated. The larger the degree of integration of an integrated circuit becomes, the greater the heat generation becomes. Also in case of a light emitting element, the problem of heat generation is serious because a large forward current is passed therethrough.

Moreover, elements employing a single crystal compound semiconductor wafer have characteristics of high-speed operation. In order to operate an element at high speed, a large current must generally be kept flowing and the consumption of current becomes greater. Accordingly, an element of GaAs etc. poses a serious problem in view of heat generation as compared with a silicon semiconductor element.

An additional disadvantage is that the thermal conductivity of the compound semiconductor is lower than that of silicon. The heat generated by the elements mostly passes through a chip and escapes from the back of the chip into a package.

Also the package is designed to accelerate heat radiation. For example, the package is made by laminating thin ceramic plates of $Al_2O_3$ and the like, and the part contacted with an IC chip is made of a metal plate.

There is also a problem of the efficiency of heat radiation within the chip due to the heat transfer from the surface to the back thereof. The heat radiation is accelerated by merely reducing the thickness of the semiconductor chip. Consequently, the back of the wafer is ground to reduce its thickness after elements have been fabricated.

Also in an Si semiconductor, the back thereof is ground to reduce its thickness in case that a great deal of thermal generation occurs. Since the thermal conductivity of silicon is excellent, it is sufficient to reduce the thickness to about 400 μm.

In case of the Si semiconductor, lapping is employed to grind the back thereof. The lapping employed in this stage is different in purpose from that employed in the process of making the mirror wafer from the as-cut-wafer. However, the technique is similar to each other. The surface of the wafer is secured to a suitable pressure disc. By turning the pressure disc and contacting the disc to a platen while supplying an abrasive, the back of the wafer is lapped by the rotation of the platen and the pressure disc. The abrasive contains a large amount of abrasive grains. The back of the wafer physically contacts the abrasive grains and is shaved.

Although lapping is usable to make the wafer 400 μm thick, it is wet processing and therefore not necessarily a good method. That is, the processing time including pre- and after-processing is lengthy. As the abrasive grains are used, they may be embedded in the surface of the wafer on which elements are fabricated and thus must be washed off. The layer changed in property by lapping is large. Also, there is a problem of dealing with a large amount of waste liquid. Moreover, automation cannot be attained due to the batch processing. As set forth above, there are a number of disadvantages in the lapping method for shaving the back of the wafer on which elements are not fabricated.

Accordingly, grinding the back of the Si wafer by means of a diamond wheel was earnestly demanded.

In response to such a demand, the present inventors have succeeded in realizing a method of grinding the back of the Si wafer by a diamond wheel. The method uses a surface grinding machine as disclosed in Japanese Unexamined Published Application No. 95866/86 (laid open on May 14, 1986).

The aforesaid method has such advantages that fixed abrasive grains are used instead of free abrasive grains, processing time is short, and automation can be attained.

Such grinding the back of the wafer by means of the diamond wheel is simply called back grinding.

Due to the success of the present inventors, the back grinding is being used instead of lapping in order to reduce the thickness of the Si wafer. Although lapping is mainly used at present, back grinding seems to be mainly used in the future.

The above description is intended to show the need of making a wafer thinner and changes of methods used in processing the silicon wafer.

In case of the III-V group compound, there exists a decisive difficulty that it is fragile compared with the Si wafer.

Moreover, the thermal conductivity of the III-V group compound is lower than that of the Si wafer and, because the former compound is operated at high speed, it generates a great deal of heat. For that reason, the III-V group compound must be made as thin as up to 200 μm, whereas it is only necessary to make the Si wafer as thin as up to 400 μm. The III-V group compound is more disadvantageous as compared with the Si wafer.

Accordingly, lapping has mainly been employed for making the compound semiconductor wafer thin. Because of lapping, free abrasive grains are used. The back of the wafer is shaved without difficulty by the liquid containing the free abrasive grains. Consequently, the wafer is seldom broken or chipped off even if it is made as thin as 200 μm by grinding.

Thus, the most suitable way of making the compound semiconductor wafer thin was lapping and even now lapping is being used.

As set forth above, however, lapping is quite an inefficient method since pre- and post-processing is troublesome. Further, it has such disadvantages that the wafer must thoroughly be washed in order not to remain the abrasive gains, a large amount of waste liquid is produced, dealing with waste liquid is a difficult problem, and it is not suitable for automatic operation as it cannot be performed continuously.

There is a strong demand for thinning a compound semiconductor wafer by a diamond wheel. Although such a method has already been put to practical use for grinding silicon wafer, it can not always be applicable to the compound semiconductor wafer. Silicon is firm and hardly breakable. On the other hand, cleavage easily arises in compound semiconductors such as GaAs by a small force and are thus fragile and breakable. For that reason, back grinding by means of the diamond wheel was deemed impossible.

The compound semiconductor wafer is likely to be broken when physically contacting with the wheel. It is often broken because it is to be shaved as thin as about half of that of the Si wafer notwithstanding its fragility compared with the Si wafer.

Even though the compound semiconductor wafer is not broken, the surface thereof will be torn off along its cleavage plane. In other words, there are produced a number of cavities in the surface thereof. This is because the abrasive grains fixed to the wheel scrape the soft portion of the surface thereof locally.

If the surface is torn off, the back of the wafer does not become a mirror surface. If the back thereof is not a mirror surface, the chip will not smoothly contact with the package when the chip is die-bonded to the package and this causes the thermal resistance to inconveniently increase.

Namely, grinding the back of the fragile compound semiconductor wafer is very difficult compared with the case of grinding the Si wafer.

SUMMARY OF THE INVENTION

An object of the present invention is to provide a surface grinding machine capable of grinding the back of a compound semiconductor wafer so as to prevent the wafer from breaking even though it is made thin as 200 μm or less.

The surface grinding machine according to the present invention comprises a grinding wheel head supported movably in the vertical direction; a cup-shaped diamond wheel supported by a rotatable wheel axis at one end of the wheel head and having an abrasive grain layer with Young's modulus of $(10-15)\times 10^4$ kgf/cm$^2$ at the under surface thereof; a wheel shaft driving motor for rotating the cup-shaped diamond wheel supported by the wheel head; a servomotor for vertically moving the wheel head; a suitable number of chuck tables for sucking and fixing the surface of a III-V group compound semiconductor wafer on which elements have been fabricated; an index table for rotatably supporting the chuck table; a chuck table driving motor for turning the chuck tables; a main shaft motor current analysis circuit for detecting the current value of the wheel shaft driving motor; a main shaft rotation speed analysis circuit for detecting the number of rotations of the wheel shaft driving motor; and a feed speed control circuit for controlling a servomotor in such a manner as to decrease, by obtaining grinding resistance from the current value and the number of rotations, the feed speed corresponding to a speed at which the servomotor moves down when the grinding resistance is greater than a predetermined resistance value, and increase the feed speed when the grinding resistance is smaller than the predetermined resistance value.

DETAIL DESCRIPTION OF THE INVENTION

Figure 1:
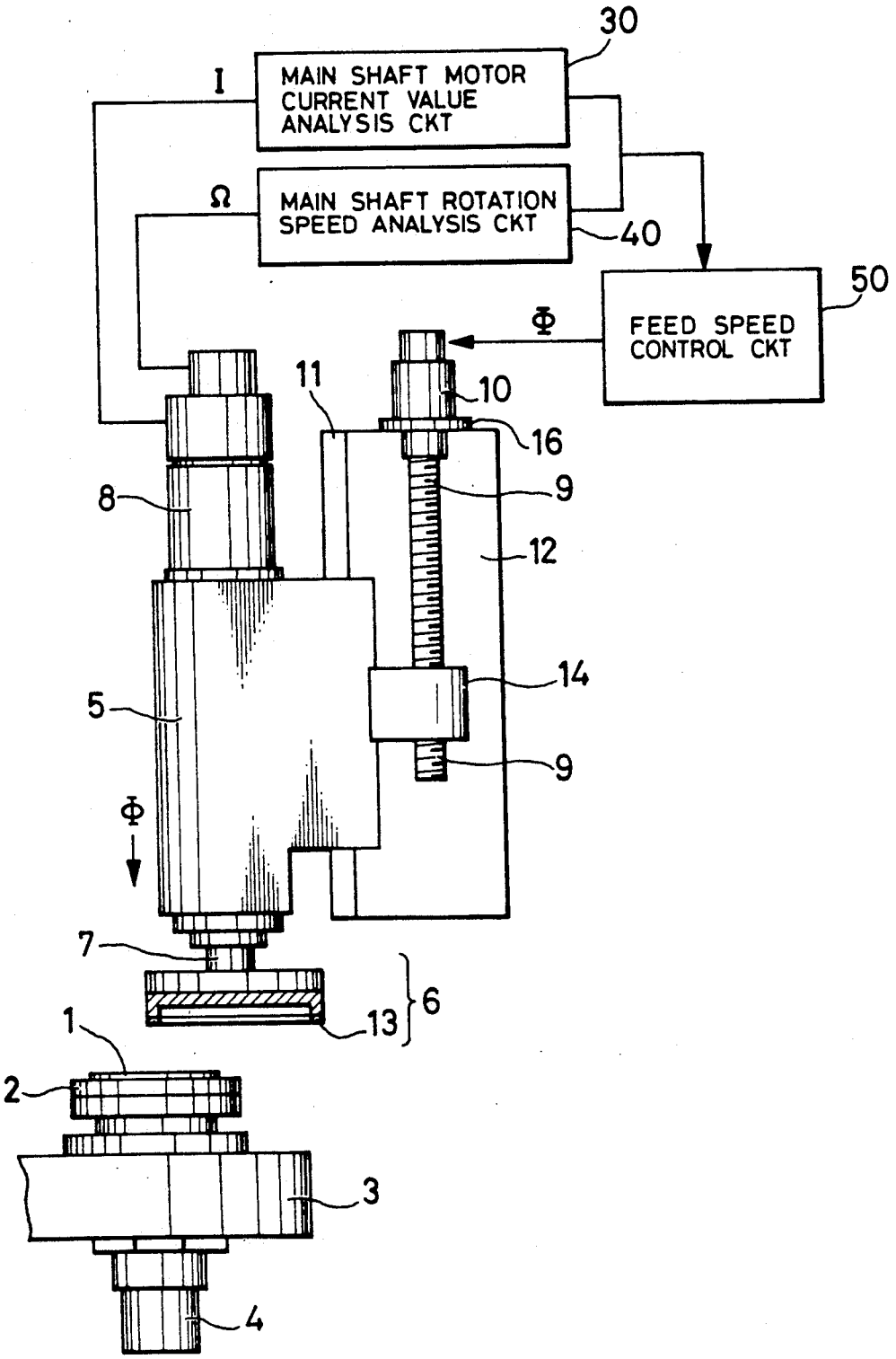
FIG. 1 is a diagram showing the construction of a surface grinding machined emboding the present invention.

The present inventors have made experiments in search of a method of grinding the back of a compound semiconductor wafer by means of a diamond wheel. A number of wafers, mainly GaAs wafers, were actually ground by the diamond wheel.

The diamond wheel is a hardened material consisting of diamond abrasive grains, a bond material and a filler.

The filler, which contributes to binding but not to grinding, consists of solid grains. As the filler, calcium carbonate, alumina, silicon carbide, copper powder or the like is usable. Although they are solid, they will not function as abrasive grains and only occupy a space. Therefore, they are solid powder having the diameter smaller than that of the diamond abrasive grain.

The bond material is use to uniformly distribute the diamond abrasive grains and t e filler to combine them so that the combination may have a fixed shape. As the bond material, a resin bond, a metal bond or a vitrified bond is usable. Further, rubber may be used as the bond material to make a rubber wheel.

The present invention is concerned with the resin bond wheel. Resin is used as a bond material. As the resin, phenol resin is mainly used. Polyimide resin may also be usable.

Diamond abrasive grains are most important among three components of the wheel since they mainly carry out the grinding operation. The diamond abrasive grains are defined by two parameters: i.e., grain size and concentration.

The size of abrasive grains of a usable diamond wheel ranges from #2,000 (6 μm) to #4,000 (2.5 μm). Grain size of #3,000 corresponds to an average diameter of about 3 μm.

Another parameter showing the properties of the diamond abrasive grain, concentration, designates the percentage in volume of diamond abrasive grains contained in the abrasive grain layer of abrasive material such as a wheel, in which 25% is converted to 100.

The physical properties of the resin diamond wheel are specified by such parameters.

The wheel is formed into a ring shape and secured to the circumferential end face of a wheel head with a U-shaped cross section. It is called a cup-shaped wheel because it looks like a bow.

Parameters must be determined through experiments for obtaining possible conditions under which the back of the wafer is ground. The following parameters are considered.

A. Grain size of diamond abrasive grain
B. Concentration of diamond abrasive grain
C. Percentage of bond material
D. Percentage of filler
E. Thickness of wheel
F. Inner diameter of wheel
G. Outer diameter of wheel
H. Peripheral speed of wheel
I. Feed speed of wheel The purpose is to grind the back of the compound semiconductor into a mirror surface. Further, it is important to grind the back of the semiconductor up to a thickness of about 200 μm without breaking the wafer or tearing the back thereof.

The present inventors ground a number of compound semiconductors and made experiments under many conditions. As a result, the inventors found that although the conditions E–I should be within a suitable range, the range are not peculiar to the compound semiconductor wafer. On the other hand, the physical properties A–D of the wheel were seen to be closely related to polishing the wafer into a mirror surface without cleaving it. However, the optimum grinding conditions cannot be defined even though one of the conditions A–D is determined. Some of conditions A–D are related to one another.

Young's modulus determined by the conditions A–D will now be considered. It is defined by dividing the force applied to a unit area of a material by its distortion produced thereby. It may be called a value expressing the hardness of the wheel. In this field, the Young's modulus of the wheel is obtained by applying the force perpendicularly to a rod-shaped material supported at one or both ends and measuring the bending amount of the material. Accordingly, the Young's modulus is called a bending modulus of elasticity in this field.

The unit of Young's modulus is kg weight/cm$^2$ or kgf/cm$^2$. If it is large, the material is hardly bent that is, the material is hard. If it is small, the material is soft.

The Young's modulus is determined by the conditions A–D. An optimum wheel may be given by defining the Young's modulus without defining any one of A–D. The present inventors have come to know this fact through a number of experiments.

As previously described, lapping is the technique used to make the back of the compound semiconductor wafer into a thin layer. Although not only troublesome of handling but also difficulty in dealing with waste liquid has posed a serious problem, lapping may be said to be the best method for a wafer.

Since free abrasive grains are used in lapping, it may be considered as the limit that the Young's modulus J is 0. Although $J \rightarrow 0$ may be considered ideal, the truth is not so. The application of free grains differs from that of fixed grains.

In order to make J smaller, it is preferred to use a grinding wheel containing a bold material made of soft material. For instance, a rubber wheel containing a bond material of rubber, whose Young's modulus J is small, is preferred.

However, if Young's modulus is small, the diamond abrasive grains will be entered into the rubber bond material during grinding. Then the bond material comes in contact with the wafer and therefore rubs the latter. Since the frictional coefficient between the wafer and the bond material are great, a great fictional force is applied to the wafer. For this reason, the fragile wafer is broken.

In case of the fixed abrasive grains, the abrasive grains will practically disappear if $J \rightarrow 0$ and only the friction between the bond material and the wafer is left. In case of lapping, since no bond material exists at all, the abrasive grains will come into contact with the wafer, even in case of $J \rightarrow 0$.

On the other hand, a diamond wheel having a large Young's modulus, i.e., a hard diamond wheel does not have the cushion action against the wafer so that cleavage is often generated on the surface of the wafer. Therefore, the surface cannot be polished into a mirror surface.

In other words if J is small, the water will be broken, whereas if J is great, the surface thereof will become rough and cannot be polished into a mirror surface.

The present inventors have discovered that an important parameter for realizing .the grinding of the back of a compound semiconductor wafer is the Young's modulus of a diamond wheel through a number of experiments. $J=(10-15)\times 10^4$ kg/cm$^2$ is the most suitable range.

If J is smaller than that value, the friction between the resin and the wafer will mainly occur and the strong fictional force caused thereby will damage the wafer. If J is greater than that value, the wafer will not be polished into a mirror surface.

However, that condition is not necessarily sufficient for grinding the fragile compound semiconductor wafer. If grinding is smoothly carried out and the grinding resistance is constant, that condition is sufficient. However, when the grinding resistance fluctuates, the wafer is damaged unless the fluctuation is supressed. The compound semiconductor wafer is by far fragile compared with a Si wafer and consequently the fluctuation of grinding resistance gives the wafer a fatal blow.

The grinding resistance means a resistant force received by the wheel due to the contact with the wafer. The grinding resistance is given in the form of torque because the wheel is a rotary body.

The grinding resistance is the frictional force applied to the wafer in some aspect. If the grinding resistance is 0, grinding will be impossible. If the grinding resistance is great, the great frictional force applied to the wafer will damage the wafer.

The grinding resistance should preferably be constant. However, the grinding resistance R fluctuates in accordance with the cutting property of the grinding wheel and the condition under ]which cut chips are discharged.

Given that the amount of fluctuation is $\Delta R$, there is not an important problem for the Si wafer whose allowable amount of fluctuation $\Delta R$ is large. On the other hand, since the compound semiconductor wafer is fragile, the allowable amount of fluctuation $\Delta R$ is extremely small. Accordingly, it should be $\Delta R \rightarrow 0$. Particularly when the wafer is ground up to as thin as 200 $\mu$m − 100 $\mu$m, the condition $\Delta R \rightarrow 0$ is very important.

The fluctuation of the grinding resistance R appears in the form of torque applied to the axis of the wheel. This is the torque to suppress the rotation of a motor. If the resistance R increases, the number of rotations $\Omega$ will decrease, whereat the current value I of the motor will increase.

The relation between the reverse torque and the number of rotations $\Omega$ and the current value I is fixed, because the motor for rotating the wheel is a DC motor. The current value I fluctuates because the voltage is made constant in that case. If R decreases, $\Omega$ will increase, whereas I will decrease.

That relation depends on the active characteristics of the motor. It can be generally written as follows:

$$R = R(\Omega, I) \quad (1)$$

In other, words, the grinding resistance is obtained from I and $\Omega$.

Referring to the accompanying drawings, the construction of the present invention will subsequently be described in more detail.

Figure 3:
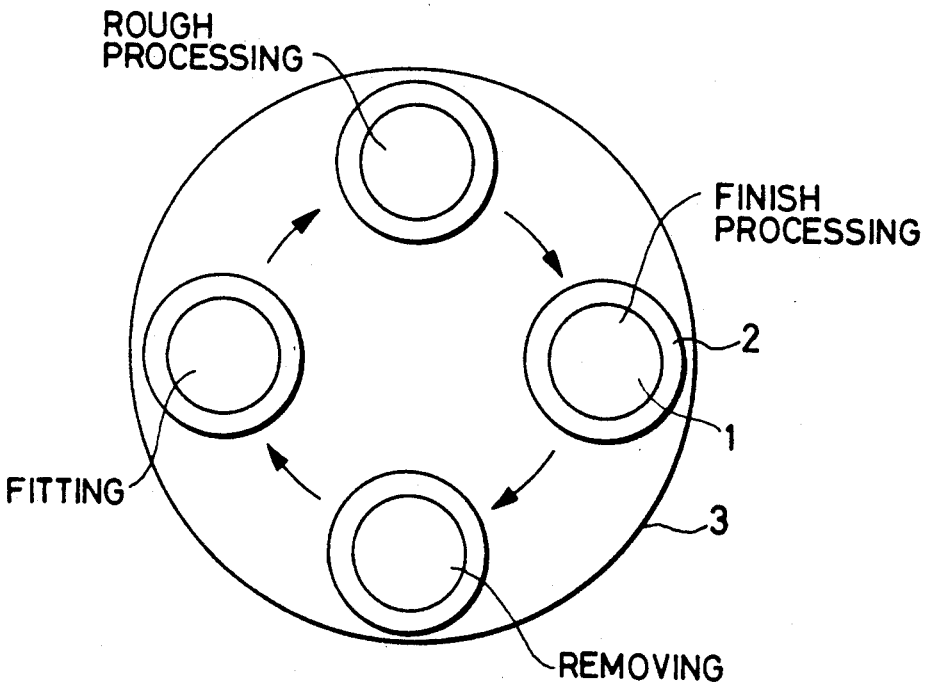
FIG. 3 is a plan view showing an index table of the surface grinding machine.

A compound semiconductor wafer 1 is subjected to vacuum chuck on a chuck table 2 with its element side down. A double-sided tape instead of the vacuum chuck may be used to secure the wafer 1 to the chuck table 2. A plurality of chuck tables 2 are provided on an index table 3. Working operation can be carried out continuously by turning the index table 3 at each step. As shown in FIG. 3, for instance, there are provided four chuck tables 2 so that four steps of fitting, rough processing, finishing and removing can be effected.

A chuck table drive motor 4 is used to turn the chuck tables 2. A grinding wheel head 5 is a member vertically movable, and a grinding wheel shaft 7 and a cup-shaped diamond wheel 6 are fitted to the lower end thereof, whereas a motor 8 for driving the wheel shaft 7 is fitted to the upper portion thereof. The wheel shaft 7 is driven and rotated by the motor 8. The cup-shaped diamond wheel 6 is simultaneously turned and, when the wheel head is lowered, the wafer is ground by the cup shaped diamond wheel 6.

The cup-shaped diamond wheel 6 is a grinding wheel including a base metal and an abrasive grain layer 13 and it is so called because it looks like a cup. and counterclockwise and its speed can freely The screw 9 is rotated by the servomotor to move the wheel head 5 vertically. By the down movement of the wheel head, the wafer face is ground little by little. The speed at which the wheel head moves down during grinding is equal to a feed speed $\Phi$. A plurality of wheel heads, cup-shaped diamond wheels, wheel shafts, servomotors, etc. may be provided so that a plurality of wafers can be simultaneously processed.

A conventional surface grinding machine is thus constructed and the wheel head is fed at a constant speed. That is, conventionally $\Phi$=constant.

In the surface grinding machine according to the present invention, a main shaft motor current value analysis circuit 30, a main shaft rotation speed analysis circuit 40, and a feed speed control circuit 50 are additionally installed in addition to the conventional grinding machine.

Figure 4:
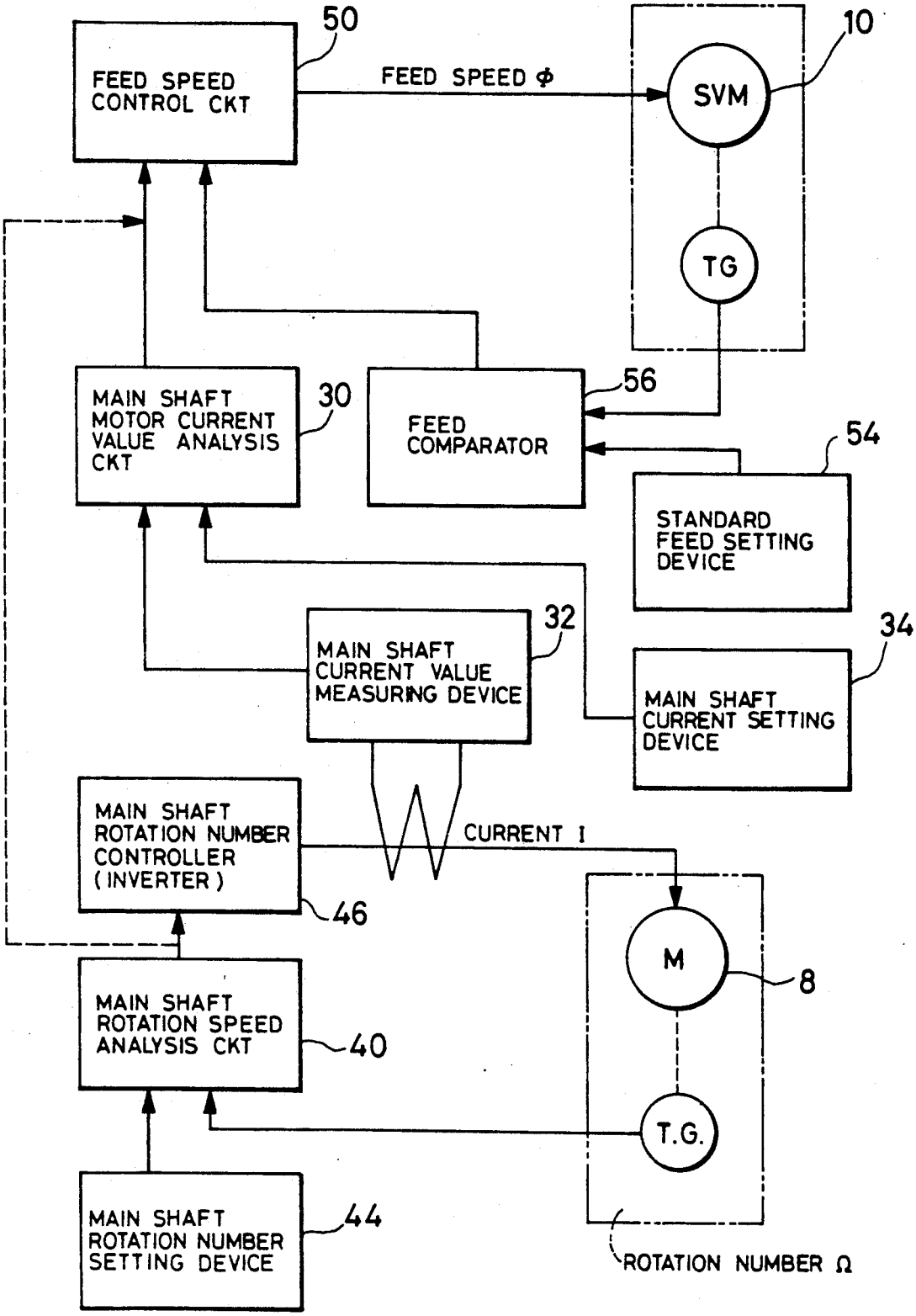
FIG. 4 is a block diagram of a circuit for keeping constant the grinding resistance.

FIG. 4 shows a block diagram showing circuits for keeping the grinding resistance constant. The construction itself of each of circuits is well known so that a detailed description of each circuit is omitted. The current I of the motor 8 for driving the wheel shaft is detected by a main shaft current value measuring device 32 and is applied to the main shaft motor current value analysis circuit 30, which also receives a predetermined current value from a main shaft current setting device 34. The rotation number $\Omega$ of the wheel shaft 7 is detected by the main shaft rotation speed analysis circuit 40, to which a predetermined rotation number is also applied from a main shaft rotation number setting device 44. A feed comparator 56 receives a predetermined grinding speed from a standard grinding setting device 54 and receives a feed speed from the servomotor 10 The output of each of circuits 30, 40 and 56 is applied to the feed speed control circuit 50, which comprises a normal grinding resistance $R_0$ with a calculated present grinding resistance R to adjust the grinding speed $\Phi$ so as to bring R close to $R_0$.

For example, in the finish processing, when the mean grinding speed is 1 $\mu$m/min, the feed speed is set to fluctuate within 0–2 $\mu$m/min.

In the above description, the normal grinding resistance $R_0$ includes conditions under which the wafer is polished into a mirror surface without being damaged.

The conditions applied to $R_0$ and the diamond wheel in rough processinq differ from those in finish processing. When the wafer must be ground by 400 $\mu$m, for instance, it may be subjected to the rough processing up to 390 $\mu$m and then to the finish processing for the remaining 10 $\mu$m. In case of the rough processing, the grain size of the diamond wheel is, for example, #800 (20 $\mu$m) and a grinding speed is 10 $\mu$m/min. In case of the finish processing, the grain size of the diamond wheel is #2,000–#4,000 (about #3,000 is particularly preferred) and a grinding speed is, e.g., 1 $\mu$m/min. The thickness of the wafer differs in both case and, when the finish processing is performed, the condition of mirror polishing is added. Accordingly, the grinding resistance $R_0$ is naturally different from each other in both cases.

Figure 2:
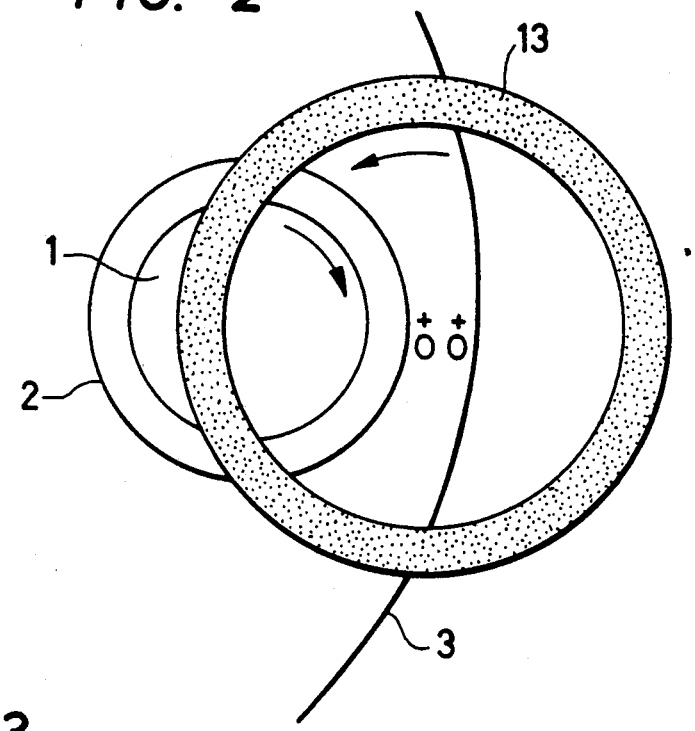
FIG. 2 is a plan view showing the proximity of the wheel and the wafer of the surface grinding machine.

As shown in FIG. 2, the center 0 of the abrasive grain layer 13 is shifted from the center O' of the wheel shaft. Thus, the abrasive grain layer 13 moves eccentrically. If the abrasive grain layer 13 does not move eccentrically (O=O') and t is worn unequally, a part not ground may remain at the center of the wafer. Consequently, it is caused to move eccentrically so as to grind the wafer flat. Further, the rotation direction of the wafer is opposite to that of the wheel. Such eccentric movement has been described in the aforesaid Japanese Patent Unexamined Published Application No. 95866/86.

When the current I increases and the number of rotations $\Omega$ decreases, the resistance R increases. Accordingly, the feed speed $\Phi$ is decreased. When the current I decreases and the number of rotations Ω increases, the feed speed Φ is increased.

The diamond wheel of the surface grinding machine according to the present invention has a Young's modulus of $(10-15)\times 10^4$ kgf/cm$^2$. The grain size ranges from #2,000 (6 μm) to #4,000 (2.5 μm). This grain size is one normally used for surface grinding. The concentration is any one between 50-200. The inner diameter F, outer diameter G and thickness E of the wheel are optional.

The Young's modulus of $(10-15)\times$kgf/cm$^2$ means a soft wheel. The Young's modulus for a wheel now in use for grinding the back of a silicon wafer is greater than the above value.

A factor for determining the Young's modulus will subsequently be described.

Since a resin bonded diamond wheel is used in the present invention, its bond material is resin. The filler is alumina, calcium carbonate, silicon carbide, copper powder or the like. The abrasive grains are diamond.

As the amount of the filler and the abrasive grains increases, the Young's modulus becomes greater. When the amount of resin increases, the Young's modulus becomes smaller. The filler contributes to increasing rigidity but provides no grinding action. For this reason, it must be composed of solid fine grains with the grain size smaller than diamond abrasive grain size.

There are three kinds of materials but, because the defining parameter is only one, if any one of the parameters is fixed with the remaining two being adjusted, it is possible to set $J=(10-15)\times 10^4$ kgf/cm$^2$.

The condition of the Young's modulus according to the present invention is intended for finish processing.

For the rough processing there is a condition that J must be greater than $10\times 10^4$ kg/cm$^2$. That is, there is a lower limit because to breakage is allowed. However, an upper limit is not always $15\times 10^4$ kgf/cm$^2$. This is the very condition under which the wafer is polished into a mirror surface. For the rough processing, the ground surface need not be a mirror surface and therefore the upper limit is not necessary.

The whole process may bL carried out under the same condition without dividing into two step. In this case, the condition of $J=(10-15)\times 10^4$ kg/cm$^2$ is required for the whole process.

Examples

Six kinds of diamond wheels containing abrasive diamond grains of grain size #3,000 (3 μm) at a concentration of 100 (i.e., 25 vol %) and having different Young's modulus were prepared and used to grind GaAs wafer.

The GaAs wafer was 3 inches in diameter. The peripheral speed of the grinding wheel was set at 2,200 m/min. The feed speed was set at 1 μm/min. The thickness of the wafer thus ground was 200 μm.

The volume ratios of the resins, the fillers and abrasive diamond grains of the diamond wheels A-F were as follows:

| | Resin (vol %) | Filler (vol %) | Abrasive grain (vol %) |
|---|---|---|---|
| A | 75 | 0 | 25 |
| B | 65 | 10 | 25 |
| C | 55 | 20 | 25 |
| D | 45 | 30 | 25 |
| E | 35 | 40 | 25 |

-continued

| | Resin (vol %) | Filler (vol %) | Abrasive grain (vol %) |
|---|---|---|---|
| F | 30 | 45 | 25 |

Phenolic resin was employed as the resin. Calcium carbonate was mainly used as the filler. However, the results were the same when alumina, silicon carbide or copper powder were used.

The back of each GaAs wafer was ground up to a thickness of 200 μm by means of those diamond wheels.

When the wheel A was used a mirror surface at the surface roughness of 0.1 μRmax was obtained. However, the wafers were frequently broken. Accordingly, the wheel A was not suitable.

The wheel F could be used to grind up to 200 μm without breakage but the surface roughness become 0.3 μRmax and a coarse surface was formed. The wheel F was also unsuitable.

The wheels B, C, D and E could be used to grind the wafers up to 200 μm without breakage and to polish into a mirror surface of the surface roughness 0.1 μRmax.

Figure 5:
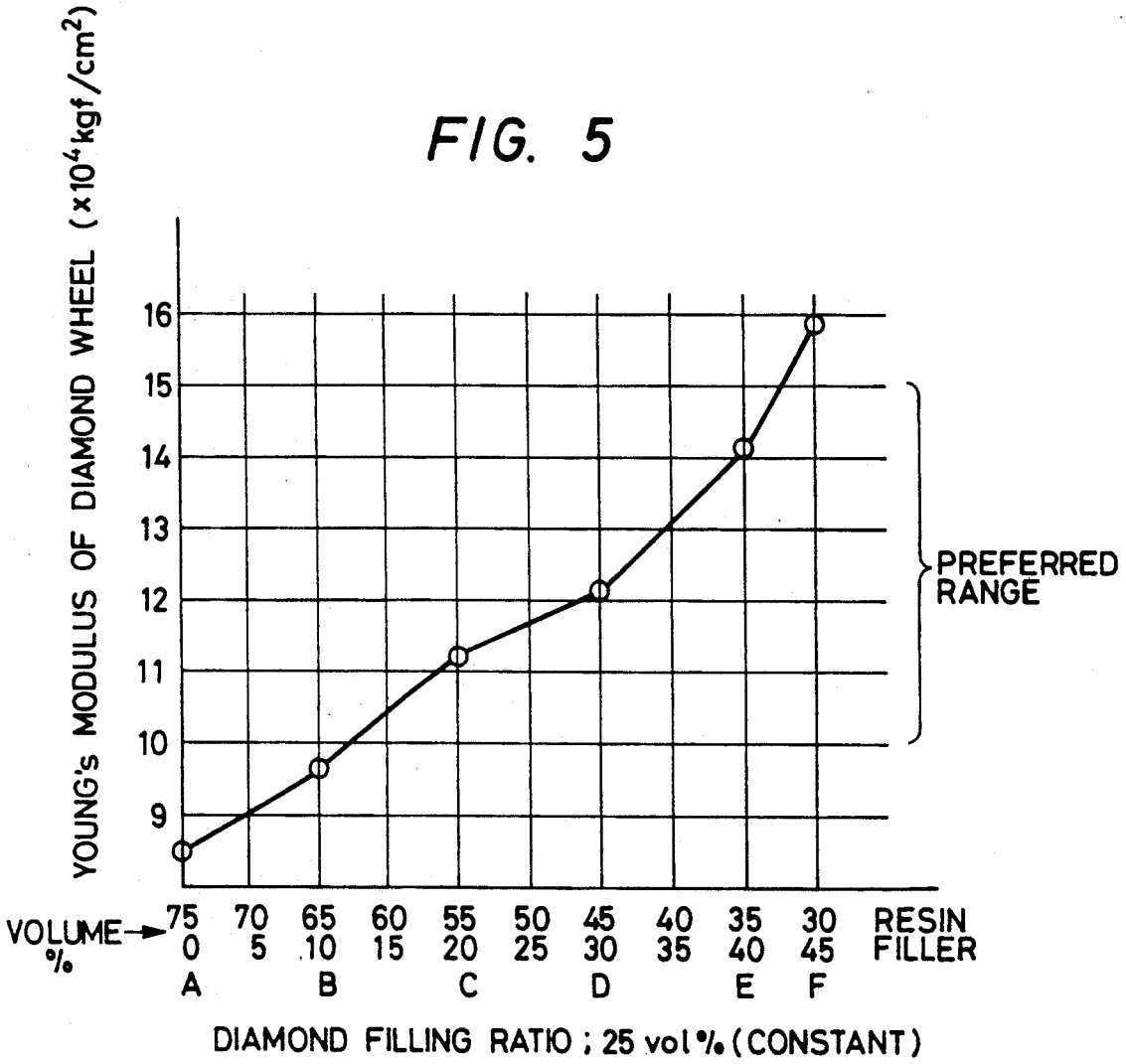
FIG. 5 is a graph showing measured values of volume percentage of each filler and resin of a resin diamond wheel and its Young's modulus.

FIG. 5 is a graph showing the measured values of the Young's moduli of the wheels A-F. The horizontal axis represents the volume ratio (%) of the resins and the fillers, whereas the vertical axis represents the Young's modulus (kgf/cm$^2$).

The wafer was often broken when the wheel A was used, and the wafer was not polished into a mirror surface when the wheel F was used. That is, the Young's modulus smaller than $10\times 10^4$ kgf/cm$^2$ or greater than $15\times 10^4$ kgf/cm$^2$ was unsuitable.

In these examples, the diamond filling ratio was set at 100 (25 vol %). The diamond filling ratio may be changed. In this case, the vol % of the resin and the filler does not become 75% in total.

Assuming the scale for the fillers on the horizontal axis is unchanged, the curve of the Young's modulus the filler deflects from this original curve to the right if the concentration of the diamond is lowered. On the other hand, if the concentration of the diamond is raised, it deflects to the left.

In any case, the Young's modulus should be $(10-15)\times 10^4$ kgf/cm$^2$.

As described above, according to the surface grinding machine of the present invention, it is possible to grind the back of the compound semiconductor wafer to make it thinner. That is, since the grinding resistance is almost made constant, the wafer can be polished into a mirror surface without breakage. Moreover, variations in the thickness of the layer changed by working are remarkably reduced. In summary, the present invention has the following advantages:

(i) Processing time is short.
(ii) Post-processing such as washing is unnecessary,
(iii) Work-changed layer is minimized.
(iv) Automated processing is possible because processing is continuously carried out.
(v) No waste liquid is produced.
(vi) Clean processing is affected.

What is claimed is:

1. A surface grinding machine, comprising:

at least one wheel head supported movably in the vertical direction;

at least one cup-shaped diamond wheel supported by a rotatable wheel shaft at one end of said wheel head, said diamond wheel having an abrasive grain layer at the lower end of said diamond wheel;

at least one wheel shaft driving motor for rotating said cup-shaped wheel, said motor being supported at the other end of said wheel head;

at least one servomotor for vertically moving said wheel head;

at least one chuck table for fixing a surface of a II–IV group compound semiconductor wafer, predetermined elements being fabricated on said surface;

an index table for revolvably supporting said chuck table;

a chuck driving table driving motor for turning said chuck table;

said surface grinding machine further comprising:

a main shaft motor current analysis circuit for detecting the current value of said wheel shaft driving motor a main shaft rotation number analysis circuit for detecting the number of revolutions of said wheel shaft driving motor; and a feed control circuit for controlling said servomotor in such a manner as to decrease, by obtaining grinding resistance from the number of revolutions the feed speed corresponding to a speed at which said wheel head moves down when the grinding resistance is greater than a predetermined resistance value, and increase the feed speed when the grinding resistance is smaller than the predetermined resistance value.

* * * * *